US009466204B2

(12) United States Patent
Olson

(10) Patent No.: US 9,466,204 B2
(45) Date of Patent: Oct. 11, 2016

(54) PATIENT POSITION MONITORING DEVICE

(71) Applicant: Professional Security Corporation, Hiawatha, IA (US)

(72) Inventor: Richard T. Olson, Hiawatha, IA (US)

(73) Assignee: Professional Security Corporation, Hiawatha, IA (US)

( * ) Notice: Subject to any disclaimer, the term of this patent is extended or adjusted under 35 U.S.C. 154(b) by 69 days.

(21) Appl. No.: 14/581,073

(22) Filed: Dec. 23, 2014

(65) Prior Publication Data

US 2016/0180691 A1 Jun. 23, 2016

(51) Int. Cl.
*G08B 21/22* (2006.01)
*G08B 21/04* (2006.01)

(52) U.S. Cl.
CPC ..... *G08B 21/22* (2013.01); *G08B 21/0461* (2013.01)

(58) Field of Classification Search
CPC ..... A61G 7/1026; G08B 21/22; G08B 21/0415; G08B 21/0461; G08B 21/0492; G08B 21/02; A61B 5/6892
USPC ..... 340/573.4, 666, 573.1; 600/595
See application file for complete search history.

(56) References Cited

U.S. PATENT DOCUMENTS 4,638,307 A * 1/1987 Swartout ..... G08B 21/0446 200/85 A
4,907,845 A * 3/1990 Wood ..... A61B 5/1115 200/85 R
6,078,261 A * 6/2000 Davsko ..... A61B 5/1115 200/85 R
6,166,644 A * 12/2000 Stroda ..... A61B 5/1113 340/521
6,847,301 B1 1/2005 Olson
7,012,534 B2 3/2006 Chaco
7,378,975 B1 * 5/2008 Smith ..... A61B 5/1126 340/573.1
8,085,154 B2 12/2011 Williams et al.
2008/0015903 A1 * 1/2008 Rodgers ..... G06F 19/327 705/3
2008/0169931 A1 * 7/2008 Gentry ..... A61B 5/1113 340/573.1
2014/0232556 A1 * 8/2014 Williams ..... H04Q 9/00 340/870.09

* cited by examiner

*Primary Examiner* — Tesfaldet Bocure
(74) *Attorney, Agent, or Firm* — Shuttleworth & Ingersoll, PLC; Jason R. Sytsma

(57) ABSTRACT

A personal monitoring system includes a pad for positioning under a patient. A sensor in the pad detects when the patient gets off of the pad. A radio in communication with the sensor transmits a radio frequency event signal to a monitor positioned away from the pad that provides an alarm signal in response to the patient getting off of the pad. The monitor transmits a confirmation signal to the pad to inform the pad to cease transmitting the event signal.

14 Claims, 5 Drawing Sheets

PATIENT POSITION MONITORING DEVICE

BACKGROUND

The present invention relates to a patient monitoring system, and more particularly to a wireless alarm system with a pressure sensitive pad that sounds an alarm when weight is removed from the pad.

There are many individuals who are physically challenged that are confined to beds or wheelchairs because of illness, disability, or age. Many of these people require assistance in living, but typically they cannot be continuously monitored throughout the day and night. If a patient attempts to leave a bed or chair, or falls out of a bed or chair, they may lie unconscious for a period of time endangering their health and life. To aid in the care of these individuals, medical safety devices have been developed that sound an alarm when a person falls or wanders off against the wishes of the caregiver. The noise produced by these safety devices alerts nurses or other aid personnel that the patient is in need of assistance.

SUMMARY

A personal monitoring system is disclosed. The personal monitoring system includes a pad for positioning under a patient. A sensor in the pad detects when the patient gets off of the pad. A radio in communication with the sensor transmits a radio frequency event signal to a monitor positioned away from the pad that provides an alarm signal in response to the patient getting off of the pad.

The personal monitoring system can include a second radio in the monitor to communicate with the radio in the pad. In an embodiment, the second radio communicates a confirmation signal to inform the pad that the alarm signal from the pad has been received. In an embodiment, the first radio in the pad can communicate the alarm signal continuously until the confirmation signal from the monitor is received. In an embodiment, the monitor also can communicate a malfunction signal when the pad or the monitor is not functioning properly.

These and other embodiments will be better understood in the context of the following figures, the detailed description, and the claims.

DETAILED DESCRIPTION

Figure 1:
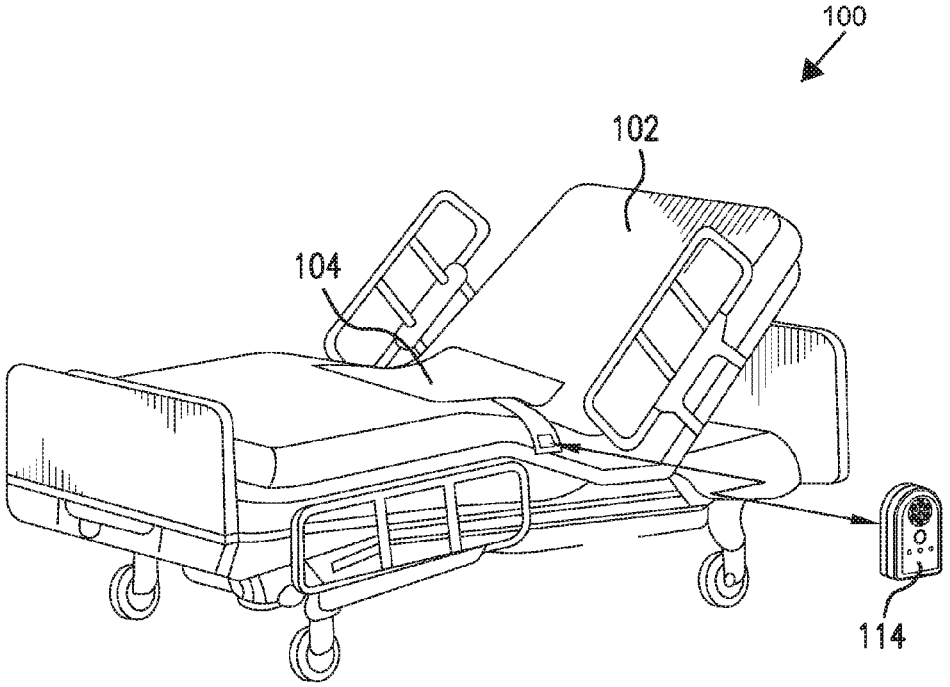
FIG. 1 is a perspective view illustrating a bed with a pressure sensitive pad with a wireless radio transmitter attached to the pad.
Figure 2:
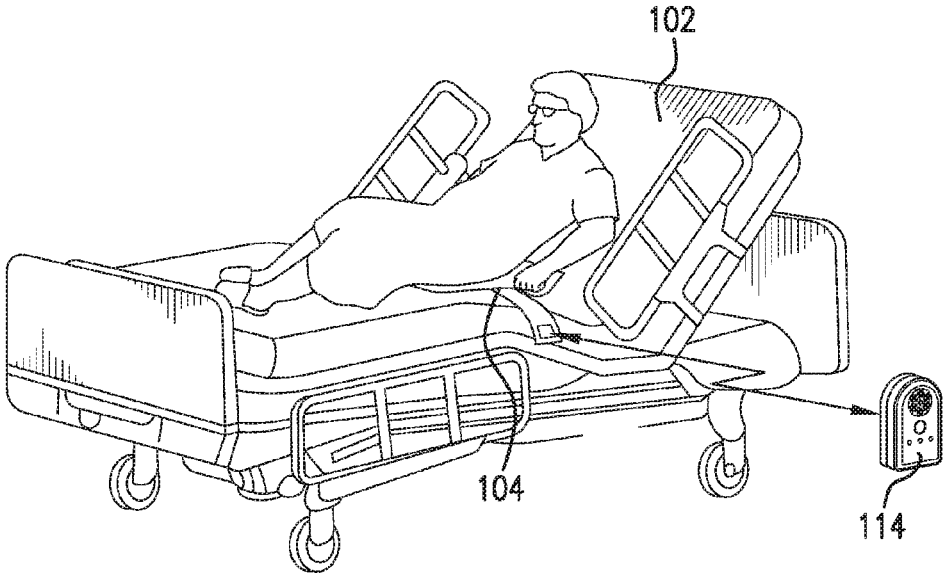
FIG. 2 is a perspective view illustrating a patient lying in bed on the pressure sensitive pad.

A personal monitoring system 100 is disclosed. Personal monitoring system 100 sounds an alarm when a patient gets off of a bed 102. FIGS. 1 and 2 show a pad 104 positioned on bed 102 in a location generally aligned with the patient's posterior. This way the patient can move around bed 102, lean the upper body forward, or raise the legs up without triggering the alarm, but when the patient's posterior is moved off of bed 102, it can generally be assumed that the patient is no longer on bed 102. When the patient's weight is removed from pad 104, an alarm sounds giving a visible or audible warning to nearby caregivers.

Figure 3:
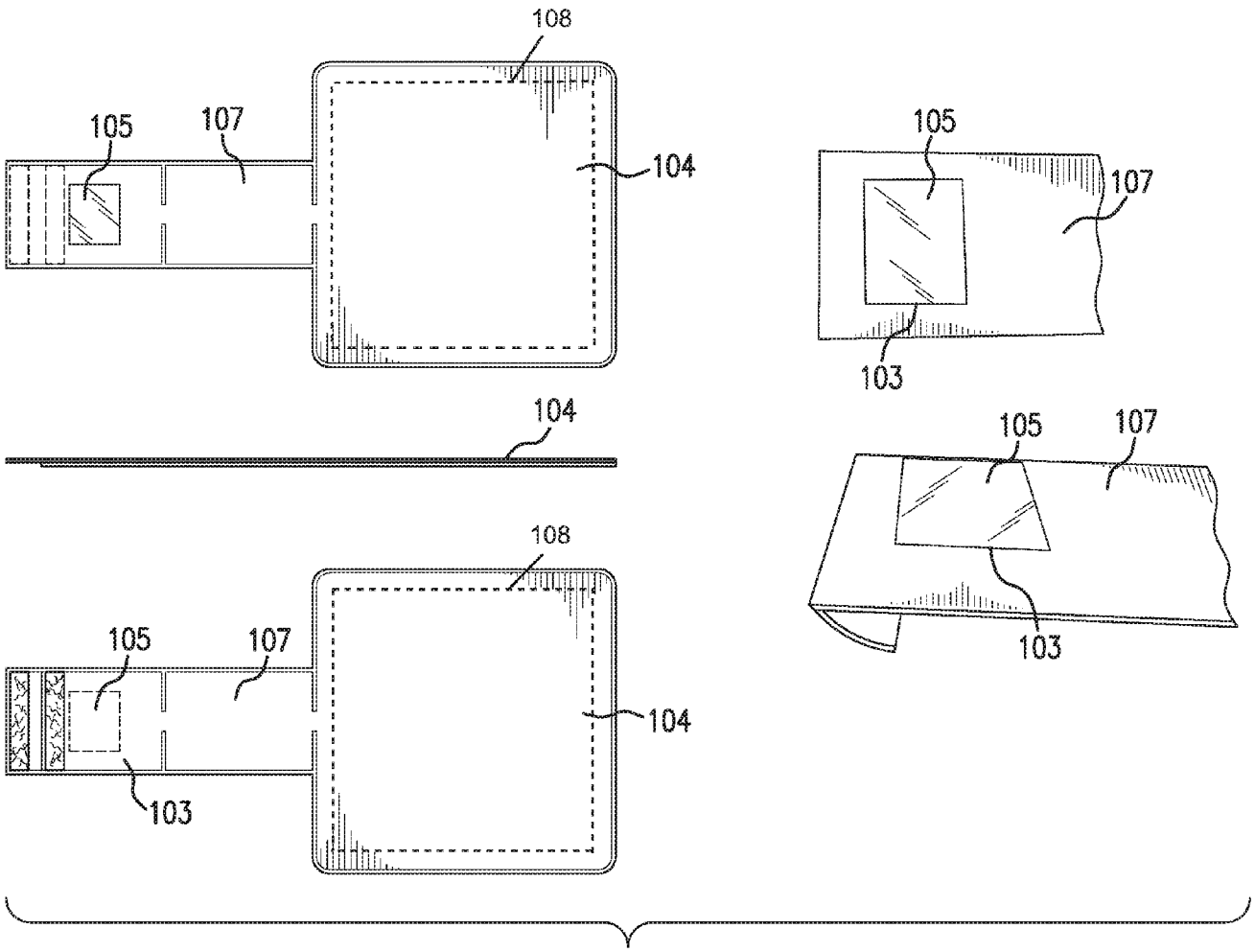
FIG. 3 shows the pressure sensitive pad of FIG. 1 from multiple perspectives.

FIG. 3 shows pad 104. Pad 104 can be of a type similar to the pad described in U.S. Pat. No. 6,847,301 by the same inventor, the contents of which are hereby incorporated by reference herein. Pad 104 includes a sensor 108 that can be a pressure-sensitive sensor of the type described in the '301 patent. Sensor 108 senses when pad 104 is expanded or compressed. There can be a resilient material such as a high-density sponge inserted in pad 104. This sponge keeps sensor 108 from activating the alarm when no weight is on pad 104. In order for sensor 108 inside pad 104 to activate and deactivate, pad 104 has a portion 107 that extends off of pad 104 and hangs off the side of bed 102 with a pocket 103 for the circuitry. Pocket 103 is not completely sealed off so air can enter and exit pad 104 from a conduit extending between the area of the sponge to pocket 103. As the patient sits on pad 104, the sponge is compressed and pad 104 can lose air into pocket 103 causing sensor 108 to deactivate. In this position, the alarm does not sound. As the patient's weight is removed from pad 104, the sponge expands, causing air to exit pocket 103 and enter into internal area of pad 104 allowing pad 104 to expand or "recover," during which time sensor 108 activates, causing the alarm to sound. Providing a pocket 103 for air from pad 104 to enter and exit so the pad can compress is unique over other pad designs that use air holes on the surface of pad 104 that also allow bodily fluids to enter. Since pad 104 does not have such air holes, the internal sponge is kept clean sterile, which extends the useful life of pad 104.

Figure 4:
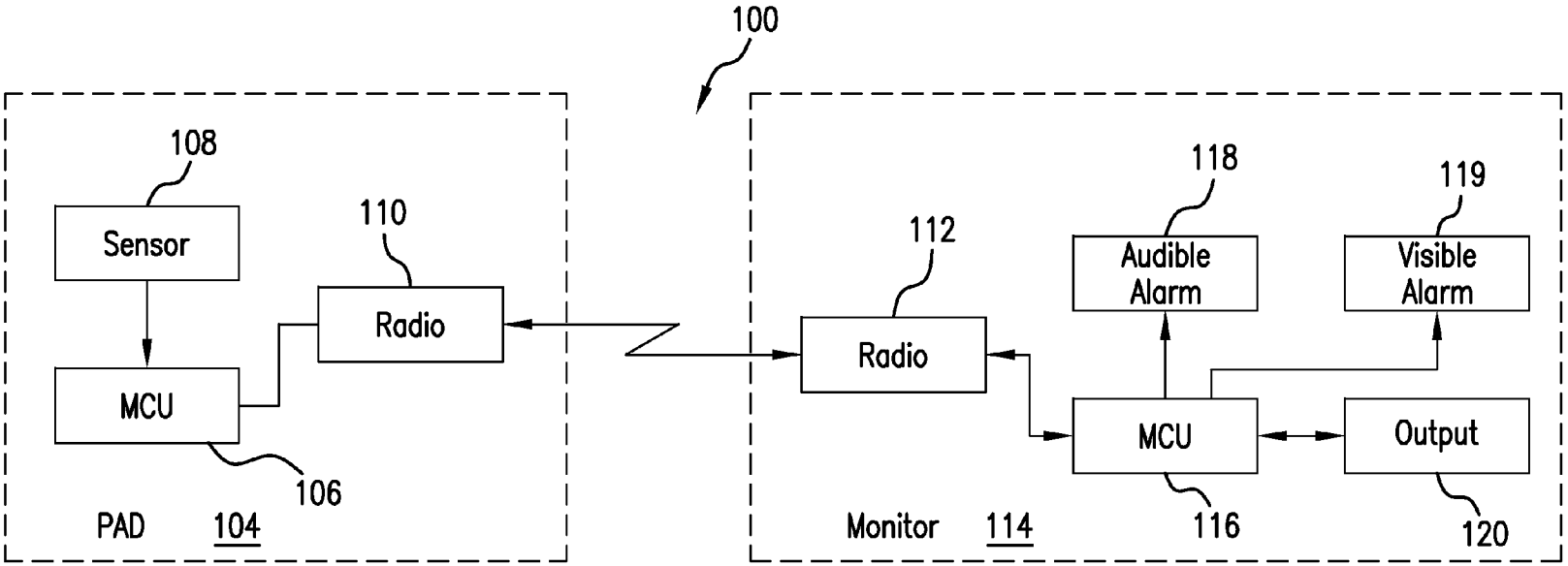
FIG. 4 is a block diagram of the personal monitoring system including the pad from FIG. 1.

The circuitry, shown in FIG. 4, including a micro-controller unit (MCU) 106 and radio 110 is positioned in portion 107 under a layer of radio transmissive material so radio 110 can communicate with monitor 114. The radio transmissive material can be a clear plastic or vinyl material 104 that allows for visual inspection of the circuitry. This clear vinyl window gives users the ability to see a low battery indicator light electrically connected to MCU 106.

FIG. 4 shows personal monitoring system 100. Pad 104 includes MCU 106. MCU 106 provides system-level control for the circuitry in pad 104, and includes software operating thereon to determine actions of MCU 106 based on inputs form a sensor 108 and information received from external sources via a radio 110.

When MCU 106 receives a signal from sensor 108 that the pressure or weight has been removed from pad 104, MCU sends an event signal through radio 110 to a corresponding radio 112 in a monitor 114. Radio, as used in this disclosure, is construed broadly to cover any type of transmitter, receiver, or combination transceiver capable of wireless communication across any channel or frequency band. In the illustrated embodiment of FIG. 5, radio 110 and radio 112 communicate with each other over 2.4 GHz frequency band.

When monitor 114 receives the event signal from radio 110 in pad 104, an MCU 116 processes the event signal and sends an alarm signal to an alarm 118. MCU 116, like MCU 106, provides system-level control for the circuitry in monitor 114, and includes software operating thereon to determine actions of MCU 116 based on information from pad 104 and information received from external sources such as a reset input connected to a reset button 125 on the front face of monitor 114.

In response to an event signal from pad 104 that the patient got off pad 104, MCU 116 can take one or both of the following actions. If monitor 114 is connected to a nurse call station, monitor 114 can send an alarm signal out output port 120 to the nurse call station where the alarm signal can be received by a separate computer or trigger one or more various audible or visible alarms or activate a paging device located with the nurse.

If monitor 114 is not connected to a nurse call station, an on-device visible alarm 119 and audible alarm 118 are available. Audible alarm 118 can be a buzzer or speaker that sounds an audible alarm when triggered. A volume adjustment can be provided to increase or decrease the volume, also software on MCU 116 can change the tone or audible allow to a constant noise or a series of pulses. A visible alarm 119 can also be provided. Visible alarm 119 can be a light-emitting diode (LED) on the front of monitor 114. In response to an alarm signal, visible alarm 119 can flash at a predetermined frequency.

MCU 106 on pad 104 is programmed to transmit the event signal in response to a patient getting off of pad 104 until MCU 106 receives an acknowledgement from monitor 114 that the event signal has been received. When MCU 116 receives the event signal from pad 104, MCU 116 sends a confirmation signal through radio 112 back to radio 110 in pad 104. MCU 116 can be programmed to send continuously or periodically the confirmation signal until the confirmation signal has been received MCU 116. Once MCU 106 receives through radio 110 the confirmation signal, it stops sending the event signal, which provides notice to MCU 116 on monitor 114 that the confirmation signal has been received.

If the confirmation signal from MCU 116 is not turned off in a pre-determined amount of time, MCU 116 can send a malfunction signal to indicate that there is a problem with personal monitoring system 100. The malfunction signal can operate in the same manner as described above when a patient gets off of pad 104 or in a different manner. In the illustrated embodiment, MCU 116 causes visible alarm 119 to flash continuously and audible alarm 118 to sound. MCU 116 can be programmed to transmit the malfunction signal after any amount of time, but the illustrated embodiment the malfunction signal is transmitted after 5 minutes to extend the battery life, although any time between 1 minute and 10 minutes can be used. The malfunction signal can be provided until MCU 116 is shut off or receives a functional signal from pad 104.

Personal monitoring system 100 also has programmed therein safety protocols to keep it operational. MCU 106 on pad 104 sends a functional signal via radio 110 to monitor 114 to periodically to let monitor 114 know pad 104 is operational and that there is an uninterrupted communication path between radio 110 on pad 104 and radio 112 on monitor 114. The periodicity of the functional signal can be programmed by MCU 106 to any interval, but the preferred range is between 1 minute and 10 minutes (with any value there between). In the current embodiment, the functional signal is transmitted every 2.5 minutes.

Monitor 114 also has low battery indicators for both pad 104 and monitor 114. MCU 106 can send a low batter signal via radio 110 to monitor 114 to let it know that its battery is low. In response to such a signal, MCU 116 can provide a pad low battery alarm signal to a pad low-battery visible alarm 121 in the form of an LED on the front face of monitor 114. Similarly, MCU 16 can provide a monitor low battery alarm signal to a monitor low battery visible alarm 123 in the form of an LED on the front face of monitor 114. The pad low battery alarm signal and the monitor low battery alarm signal can also be sent out output port 120 to the nurse call station or to one or both audible alarm 118 and visible alarm 119.

MCU 116 on monitor 114 is programmed to listen for functional signal from pad 104. If MCU 116 does not receive the functional signal at the determined time, an alarm signal is triggered by MCU 116. The alarm signal can operate in the same manner as described above when a patient gets off of pad 104 or in a different manner. In the illustrated embodiment, visible alarm 119 is activated as a constant solid light from an LED to indicate to the staff that there's a problem with the communication between pad 104 and monitor 114.

Personal monitor system 100 also has other patient safety features. For example, there is virtually no delay between a patient getting off of pad 108 and the alarm. The alarm signal from MCU 116 is triggered near substantially instantaneously. This is important because the risk associated with a patient getting off of pad 104 outweighs the inconvenience to the staff from movements that might cause the patient to momentarily get off of pad 104.

If the patient briefly gets up off of pad 104 and triggers the alarm, personal monitoring system 100 can be reset by pressing reset button 125 on face of monitor 114 and the alarm deactivated by the patient getting back onto pad 104 within a predetermined amount of time. The amount of time is generally short, preferably in the range of 0 to 60 second (with any value in between). An immediate alarm will often startle the patient and cause the patient to get back onto pad 104, in which case the alarm is deactivated.

Figure 5:
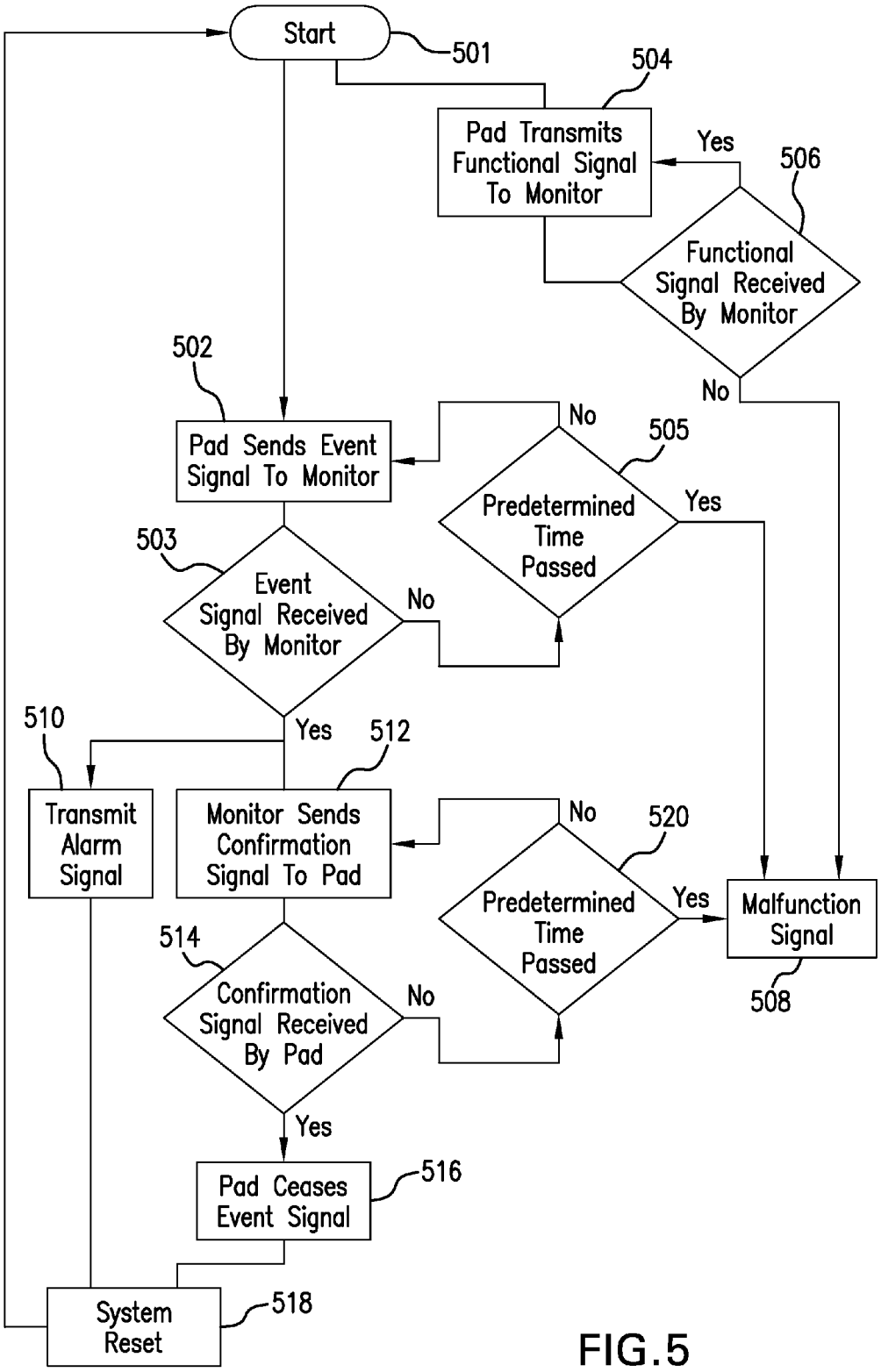
FIG. 5 is a flow chart showing the communication between the pressure sensitive pad and the monitor.
Figure 6:
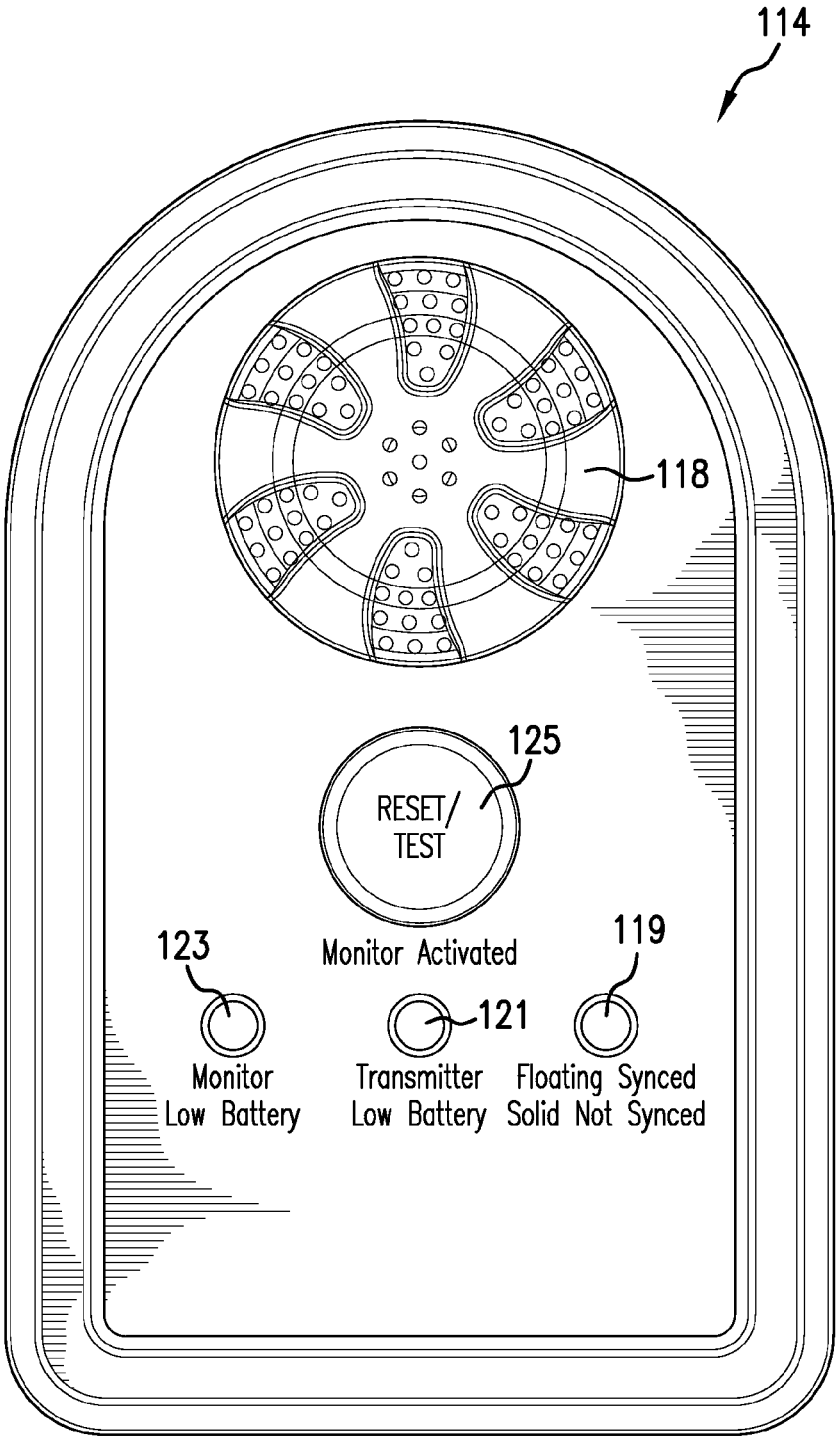
FIG. 6 shows the monitor.

The foregoing can also be understood in the context of FIG. 5, which shows a method of bi-directional communication between pad 104 and monitor 114. The method begins at step 501. Pad 104 can simultaneously or in succession transmit to monitor 114 an event signal in step 502 and a functional signal in step 504. Pad 104 continues transmitting the functional signal to monitor 114, as indicated by decision block 506. As long as monitor 114 receives the functional signal it will not take any action, but if monitor 114 does not receive the functional signal after a predetermined amount of time it will initiate the malfunction signal, as indicated in step 508.

Returning to the event signal, at step 502, the method determines whether the event signal was received by monitor 114 at step 503. If so, monitor 114 will transmit an alarm signal at step 510 and send a confirmation signal to pad 104 at step 512. If not, the method determines whether a predetermined amount of time has passed at step 505, and, if so, monitor 114 sends a malfunction signal at step 508. Otherwise, pad 104 continues to send the event signal to monitor 114.

At step 514, the method determines whether the confirmation signal was received by pad 104. If so, pad 104 stops sending the event signal at step 516 and the system is reset at step 518 so the method can begin again. If the confirmation signal is not received by pad 104, the method determines whether a predetermined amount of time has passed without receipt of the confirmation signal, at step 520. If so, the monitor initiates the malfunction signal at step 508. If not, the monitor continues to send the confirmation signal, as provided in step 512.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A personal monitoring system comprising:

a pad;

a sensor attached to the pad for detecting a patient on the pad;

a first radio in communication with the sensor for transmitting an event signal from the sensor in response to the person getting off of the pad; and a monitor positioned apart from the pad for receiving the event sign from the first radio and providing an alarm signal in response to receiving the event signal from the first radio, and a second radio in communication with the first radio for receiving the event signal and responding to the first radio with a confirmation signal, wherein first radio transmits the event signal continuously unit the first radio receives the confirmation signal from the second radio and wherein the first radio ceases transmission of the event signal when the first radio receives the confirmation signal from the second radio, and wherein the monitor provides a malfunction signal in response to receiving the event signal continuously form the first radio for more than 1 minute, and the malfuncation signal is provided until the monitor is shut off or the monitor receives a function signal.

2. The personal monitoring system of claim 1, wherein the radio ceases transmitting the event signal in response to the person getting on the pad.

3. The personal monitoring system of claim 1, wherein the alarm signal activates one of an audible alarm and a visible light.

4. The personal monitoring system of claim 1, where the first radio communicates a low battery signal to the monitor when a battery for the pad is low.

5. A personal monitoring system comprising:

a pad;

a sensor attached to the pad for detecting a patient on the pad;

a first radio in communication with the sensor for transmitting an event signal from the sensor in response to the person getting off of the pad; and a monitor positioned apart from the pad for receiving the event sign from the radio and providing an alarm signal in response to receiving the event signal from the first radio, wherein the first radio communicates periodically a functional signal to the monitor to indicate that the pad is operational.

6. The personal monitoring system of claim 5, wherein the functional signal is communicated periodically a predetermined amount of time between 1 minute and 10 minutes.

7. A method of bi-directional communication between a pad and a monitor, the method comprising:

sending an event signal from a pad to a monitor;

receiving the event signal at the monitor;

sending a confirmation signal from the monitor to the pad;

ceasing the event signal in response to receiving the confirmation signal from the monitor; and transmitting periodically a functional signal from the pad to the monitor.

8. The method of claim 7, transmitting a malfunction signal from the monitor in response the monitor not receiving the functional signal from the pad after a predetermined amount of time.

9. The method of claim 7, and further comprising transmitting a malfunction signal from the monitor in response to the monitor not receiving the confirmation signal from the monitor.

10. The method of claim 9, wherein the step of transmitting the malfunction signal occurs after a predetermined amount of time has passed after the monitor has sent the confirmation signal to the pad and the pad continues sending the event signal.

11. A personal monitoring system comprising:

a pad having a compressible material and a portion extending off of the pad with an internal pocket with a conduit between the compressible material and the pocket for directing air from the compressible material to the pocket so the pad can compress;

a sensor attached to the pad for detecting a patient on the pad;

a first radio in communication with the sensor for transmitting an event signal from the sensor in response to the person getting off of the pad; and a monitor having a second radio in communication with the first radio for receiving the event signal and responding to the first radio with a confirmation signal and wherein the monitor provides an alarm signal in response to receiving the event signal from the first radio, wherein the radio communicates periodically a functional signal to the monitor to indicate that the pad is operational and the monitor provides a malfunction signal in response to not receiving the functional signal after a predetermined amount of time has passed.

12. The personal monitoring system of claim 11, wherein the first radio ceases transmission of the event signal when the first radio receives the confirmation signal form the second radio.

13. The personal monitoring system of claim 12, wherein the monitor provides a malfunction signal in response to receiving the event signal continuously from the first radio for more than 1 minutes.

14. The personal monitoring system of claim 11, wherein the first radio transmits the event signal continuously until the first radio receives the confirmation signal from the second radio.

* * * * *